US006651738B1

(12) United States Patent
Solfronk et al.

(10) Patent No.: US 6,651,738 B1
(45) Date of Patent: Nov. 25, 2003

(54) DOWNHOLE ISOLATION DEVICE WITH RETAINED VALVE MEMBER

(75) Inventors: Matthew D. Solfronk, Katy, TX (US); Dennis E. Kroll, League City, TX (US)

(73) Assignee: Baker Hughes Incoporated, Houston, TX (US)

( * ) Notice: Subject to any disclaimer, the term of this patent is extended or adjusted under 35 U.S.C. 154(b) by 0 days.

(21) Appl. No.: 10/157,308

(22) Filed: May 29, 2002

(51) Int. Cl.[7] ..... E21B 43/12
(52) U.S. Cl. ..... 166/133; 166/145
(58) Field of Search ..... 166/133, 131, 166/121, 145, 147, 184, 192, 195, 196

(56) References Cited

U.S. PATENT DOCUMENTS 4,405,017 A * 9/1983 Allen et al. ..... 166/382
4,583,593 A * 4/1986 Zunkel et al. ..... 166/382
4,928,761 A * 5/1990 Gazda et al. ..... 166/123
5,544,706 A * 8/1996 Reed ..... 166/379
5,701,959 A * 12/1997 Hushbeck et al. ..... 166/387
5,803,178 A * 9/1998 Cain ..... 166/306

* cited by examiner

*Primary Examiner*—Frank Tsay
(74) *Attorney, Agent, or Firm*—Steve Rosenblatt

(57) ABSTRACT

A downhole zone isolation device is disclosed that features a non-spherical valve member that will not rotate while being drilled out. The valve member is retained in the isolation device so that flow uphole will not allow the valve member to exit the body of the isolation device. Bypass passages around the valve member are provided so that flow uphole can lift the valve member off its seat and flow can go around its periphery. Pressure from above seats the valve member. Non-metallic materials speed drill-out.

24 Claims, 3 Drawing Sheets

DOWNHOLE ISOLATION DEVICE WITH RETAINED VALVE MEMBER

FIELD OF THE INVENTION

The field of this invention is downhole isolation devices and more specifically those devices that permit flow to the surface and are removable by milling or drilling.

BACKGROUND OF THE INVENTION

In certain downhole operations, it is desirable to isolate a portion of the wellbore. This can occur when perforation a zone in a cased borehole. Another occasion is when fracturing a formation through a set of perforations in one zone and having to isolate the remainder of the wellbore from the applied pressures of that procedure. Usually, these barriers are temporary and need to be removed from the wellbore when a perforating or fracturing operation is concluded. For these reasons, these devices have been made with non-metallic materials to enhance drillability.

In the past, these devices have had a passage through them to permit flow toward the surface. When isolation between zones was needed, a ball was dropped from the surface to land on a seat in the isolation device and pressure was built up on the seated ball. There were two main disadvantages to this design. Even if the ball was run with the isolation device instead of being dropped in later the mill-out was problematic because the ball could rotate on the seat during the milling. So even though the isolation device was predominantly of non-metallic materials, the milling process was still prolonged. The other issue with the prior designs was that the ball was not retained to the isolation device so that flow towards the surface could bring the ball out with it and get it stuck in the blowout preventers, creating a safety concern. An example of this type of design is the FAS DRILL Bridge Plug offered by Halliburton. Other prior designs for zone isolation involved flapper type valves held open with a stinger or sliding sleeve designs operated with a stinger.

The present invention seeks to address the issue and solve the problems associated with the known devices. It comprises a non-spherical valve member that will not rotate during mill-out. The valve member is also retained so that it will not be carried uphole to wind up in the blowout preventers. Non-metallics are used to promote drillability. A plurality of the isolators of the present invention can be used and milled out after all the zones have been completed. These and other benefits of the present invention will be apparent to those skilled in the art from a review of the description of the preferred embodiment described below.

SUMMARY OF THE INVENTION

A downhole zone isolation device is disclosed that features a non-spherical valve member that will not rotate while being drilled out. The valve member is retained in the isolation device so that flow uphole will not allow the valve member to exit the body of the isolation device. Bypass passages around the valve member are provided so that flow uphole can lift the valve member off its seat and flow can go around its periphery. Pressure from above seats the valve member. Non-metallic materials speed drill-out.

DETAILED DESCRIPTION OF THE PREFERRED EMBODIMENT

Figure 1:
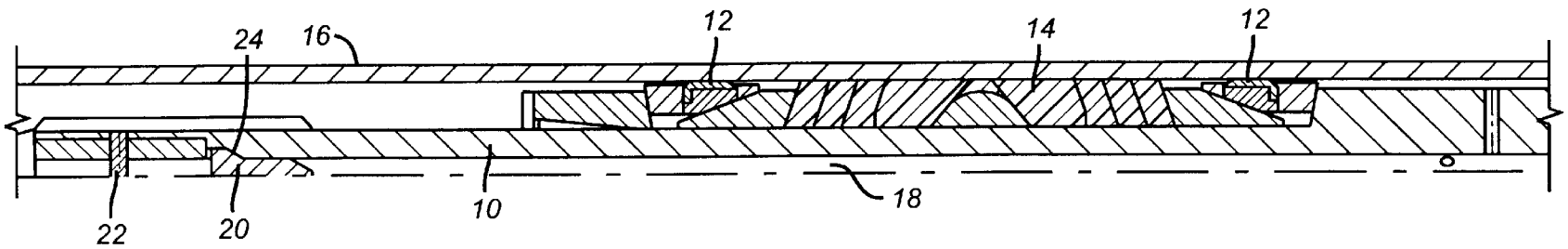
FIG. 1 is a section of the isolation device with the valve member in the seated position.
Figure 2:
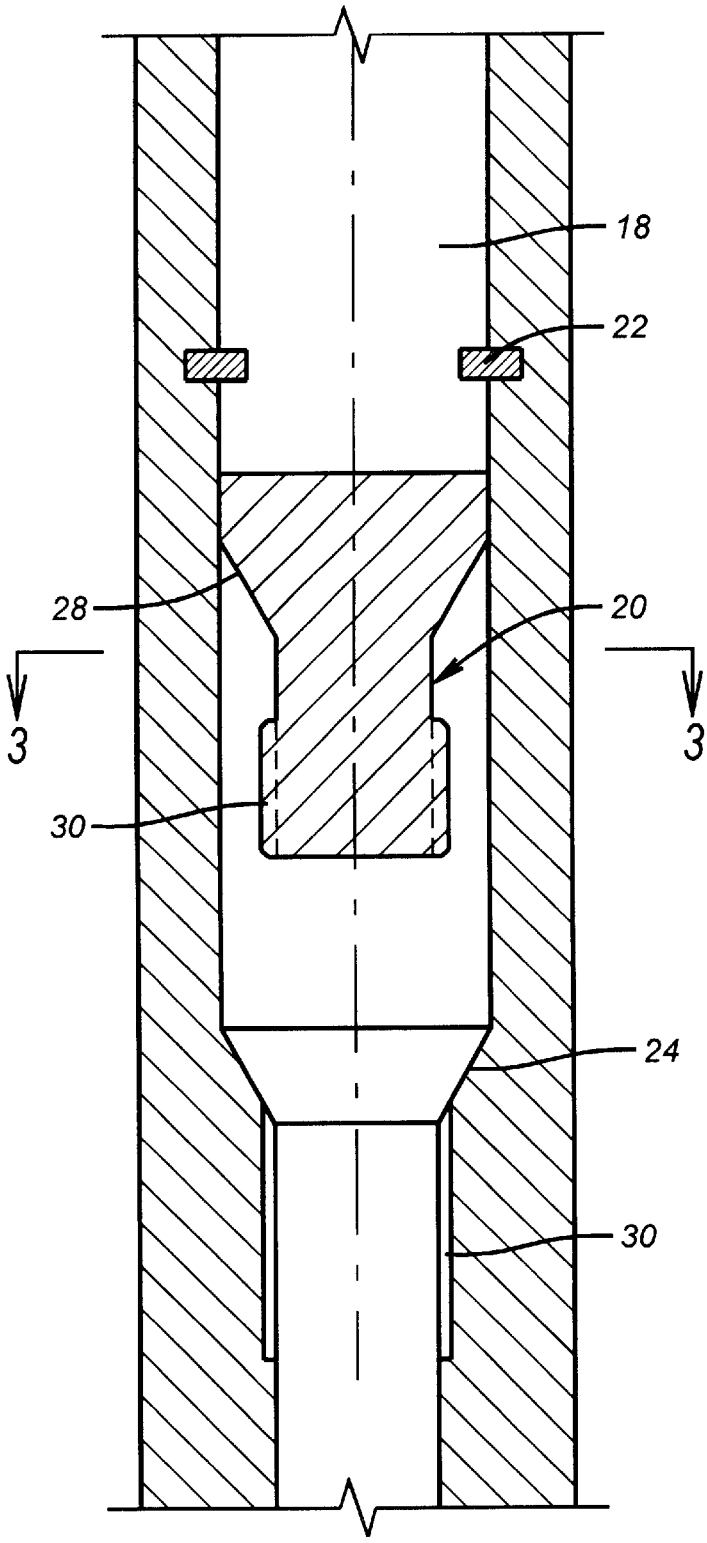
FIG. 2 is a section of a portion of the isolation device showing the valve member off the seat during flow uphole.

Referring to FIG. 1, the apparatus A can have the components of known bridge plugs or packers by way of a body 10, slips 12 and a sealing element 14. FIG. 1 illustrates the set position downhole against a casing 16. A passage 18 extends through body 10.

The present invention comprises a plug 20 movably mounted in passage 18. A travel stop 22 which can be one or more pins, a shoulder or any other obstruction, prevents plug 20 from being driven out of body 10 when uphole flow occurs through passage 18. Passage 18 has a plug seat 24 located within body 10. The seat 24 location is to be contrasted with prior devices that used a dropped ball. These devices had the seat at the very top of the passage such as 18, making mill-out difficult, as the ball would spin on the seat in response to the operation of the mill. In the present invention, the seat 24 is within the body 10, which is preferably made of a non-metallic such as, laid up fiberglass. The plug 20 is preferably a molded phenolic compound although other soft materials for the body 10 and the plug 20 could be used. During mill-out, the plug 20 is so far into the body 10 that milling the body 10 will distort it dimensionally to a degree sufficient to prevent the plug from rotating by the time the bit or mill reaches it.

Figure 3:
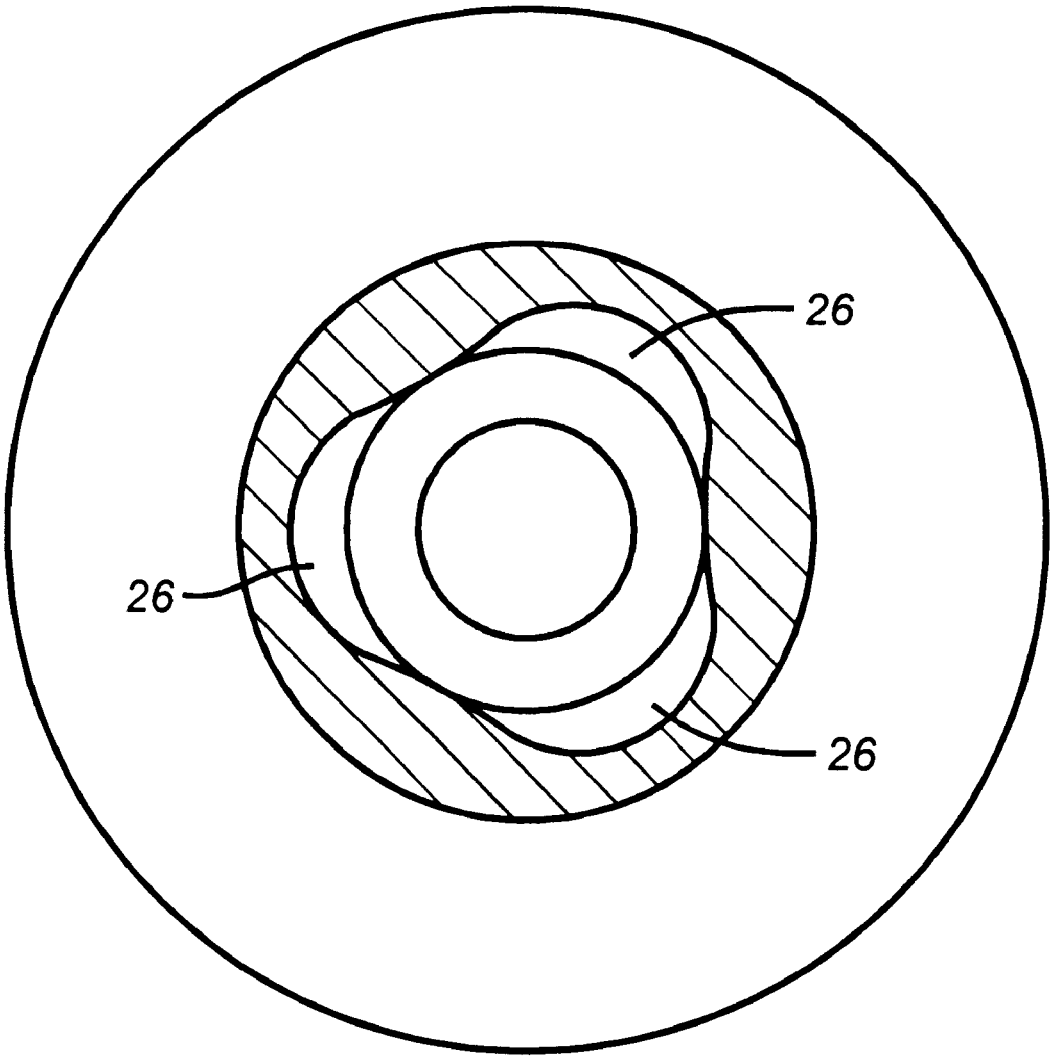
FIG. 3 is a section view along lines 3—3 of FIG. 2, showing the bypass flow passages and how the valve member is constrained against rotation.

The passage 18 accommodates uphole flow by the use of lobes 26, shown in FIG. 3. These lobes 26 form flow passages around plug 20 when uphole flow forces it off the seat 24 and against travel stop 22. Although 3 lobes are shown a different quantity may be used or some other flow path can be used to permit uphole flow as long as that flow path is closed when the plug 20 is seated on seat 24.

Optionally, the plug 20 may be biased away from seat 24. Those skilled in the art will appreciate that plug 20 is delivered into the well inside body 10 as is movably retained therein by travel stop 22. The present invention prevents the escape of plug 20 during uphole flow, keeping it out of the blowout preventers (not shown). The use of soft nonmetallic material for the body 10 and the placement of seat 24 within passage 18 provides a mechanism to rotationally lock the plug 20 when milling out. This happens because the body 10 collapses around passage 18 by the time the mill reaches plug 20. Additional protection against relative rotation can be obtained by making surface 28 and seat 24 have an undulating or sinusoidal shape instead of a frusto-conical shape. The travel stop may be below the plug 20 as opposed to above it. The seat 24 can be near or at the top of the uphole end of passage 18. The combination of a travel stop on the bottom of plug 20 and an undulating seating surface 24 allows the seat to be located near the uphole end of the body 10 without the mill-out problem associated with prior designs that used spheres on seats that were dropped from the surface. Additionally, the plug is retained to the body 10 even when the seat 24 is at or near the top. In this embodiment, the lobes 26 can be omitted as the plug 20 can rise out of body 10 while still held on the travel stop that is now below it. The travel stop can be a J-slot mechanism with the slot on the plug 20 and the pin extending into the passage 18. The plug would then be free to go up or down but not rotate. The slot can be closed after admitting the pin so as to secure the plug 20 from escape from passage 18. The pin can be on the plug and the slot on the passage to get the same result. Rotational locking of the plug 20 can be done with mating splines 30 that can be straight or helical in a direction opposite to the rotation of a mill or drill that would later be used to drill out.

The above description is illustrative of the preferred embodiment and many modifications may be made by those skilled in the art without departing from the invention whose scope is to be determined from the literal and equivalent scope of the claims below.

We claim:

1. A downhole zone isolation apparatus for engagement with a tubular, comprising:

a body having a passage there through, said body sealingly engageable to the tubular for support thereof;

said passage comprising a seat;

a plug having a sealing surface to selectively engage said seat; and said plug retained to said body when flow through said passage moves said sealing surface from said seat.

2. The apparatus of claim 1, wherein:

said plug is retained totally within said passage.

3. The apparatus of claim 1, wherein:

said passage is formed having flow passages around the exterior of said plug which are operative when flow in said passage moves said sealing surface off said seat.

4. The apparatus of claim 1, wherein:

said retention of said plug is accomplished by a projection from said body into said passage.

5. The apparatus of claim 1, wherein:

said passage and said plug are formed from a non-metallic material.

6. The apparatus of claim 5, wherein:

said passage collapses around said plug when subjected to a mill or a drill bit so as to rotationally lock said plug to said body as milling or drilling progresses.

7. The apparatus of claim 6, wherein:

said passage is formed having flow passages around the exterior of said plug which are operative when flow in said passage moves said sealing surface off said seat.

8. The apparatus of claim 7, wherein:

said plug is retained totally within said passage.

9. The apparatus of claim 8, wherein:

said retention of said plug is accomplished by a projection from said body into said passage.

10. The apparatus of claim 1, wherein:

said retention of said plug prevents escape of said plug from said passage and secures said plug against rotation within said passage.

11. The apparatus of claim 1, wherein:

said plug comprises an uphole and a downhole end and said retention by said passage engages said plug above said sealing surface and up to or including said uphole end.

12. The apparatus of claim 1, wherein:

said plug comprises an uphole and a downhole end and said retention by said passage engages said plug below said sealing surface and down to or including said downhole end.

13. The apparatus of claim 1, wherein:

said seat and said sealing surface have conforming undulating surfaces so as to rotationally lock said plug to said body when said sealing surface and said seat are engaged.

14. The apparatus of claim 1, wherein:

said plug has a spline thereon to engage a spline on said passage when said sealing surface engages said seat to prevent said plug from rotating when milled or drilled out.

15. The apparatus of claim 1, wherein:

said plug has a non-spherical shape.

16. The apparatus of claim 1, wherein:

said plug is not pivotally connected to said body.

17. A downhole zone isolation apparatus for engagement with a tubular, comprising:

a body having a passage there through, said body sealingly engageable to the tubular for support thereof;

said passage comprising a seat;

a plug having a sealing surface to selectively engage said seat;

said passage and said plug are formed from a non-metallic material;

said passage collapses around said plug when subjected to a mill or a drill bit so as to rotationally lock said plug to said body as milling or drilling progresses.

18. The apparatus of claim 17, wherein:

said passage is formed having flow passages around the exterior of said plug which are operative when flow in said passage moves said sealing surface off said seat.

19. The apparatus of claim 18, wherein:

said plug retained to said body when flow through said passage moves said sealing surface from said seat.

20. The apparatus of claim 19, wherein:

said retention of said plug prevents escape of said plug from said passage and secures said plug against rotation within said passage.

21. The apparatus of claim 17, wherein:

said seat and said sealing surface have conforming undulating surfaces so as to rotationally lock said plug to said body when said sealing surface and said seat are engaged.

22. The apparatus of claim 17, wherein:

said plug has a spline thereon to engage a spline on said passage when said sealing surface engages said seat to prevent said plug from rotating when milled or drilled out.

23. The apparatus of claim 17, wherein:

said plug has a non-spherical shape.

24. The apparatus of claim 17, wherein:

said plug is not pivotally connected to said body.

* * * * *